US005873686A

United States Patent [19]

Elmore

[11] Patent Number: 5,873,686

[45] Date of Patent: Feb. 23, 1999

[54] LAMINATE INLAY CUTTING TOOL

[76] Inventor: David A. Elmore, 10202 34th Ave. East, Tacoma, Pierce County, Wash. 98335

[21] Appl. No.: 947,370

[22] Filed: Oct. 8, 1997

[51] Int. Cl.[6] ..... B27C 5/00; B27C 1/20

[52] U.S. Cl. ..... 409/182; 30/376; 144/136.1; 144/136.95; 144/371; 156/227; 156/257; 409/183

[58] Field of Search ..... 83/496, 877, 878; 30/375, 376; 144/2.1, 134.1, 136.1, 136.95, 137, 134.5, 371, 372; 409/175, 178, 181, 182, 185, 183; 156/226, 268, 443, 510, 257, 227

[56] References Cited

U.S. PATENT DOCUMENTS

| | | | |
|---|---|---|---|
| 3,841,369 | 10/1974 | Roche | 144/136.1 |
| 3,974,565 | 8/1976 | Ellis | 30/376 |
| 4,290,464 | 9/1981 | Marsan | 30/376 |
| 4,622,090 | 11/1986 | Michaels | 144/371 X |
| 4,655,653 | 4/1987 | Hall | 409/182 |
| 4,742,856 | 5/1988 | Hehr | 144/371 |
| 4,880,042 | 11/1989 | Schafferkotter | 144/372 |
| 4,947,908 | 8/1990 | O'Banion et al. | 409/182 |
| 4,969,380 | 11/1990 | Halligan | 83/877 |

*Primary Examiner*—W. Donald Bray
*Attorney, Agent, or Firm*—James F. Leggett

[57] ABSTRACT

A device and associated method for simultaneously cutting a section of laminate to be inlaid and the underlying laminate to receive the inlay, which includes a portable cradle and a router mounted on an adjustable length shaft fitted into the chuck of the router, so that the distance that the cutting blade extends below the base of the portable cradle can be adjusted, the router is held within a rectangular router box split lengthwise on each side, hingedly held together on one side and detachably secured together on the opposite side by spring tension, with the router firmly attached to the top half so that the router cutting blade may be raised from the laminate surface by rotating the top half of the case around the hinge, while the angle of the cutting blade to the laminate is adjusted by means of adjustment screws on each side of the end of the router box opposite to the cutting blade, which rotate the router box up or down around a hinge means, on the bottom of the router box adjacent to the cutting blade, by which it is attached to the base of the portable cradle, the base has a straight edge guide extending beyond the cutting blade to assist straight line cuts of the laminate and a retractable pivot means at the center of the opposite end of the base which enable precise circular cuts of the laminate sheets. This device is utilized to cut the sheets of laminate while they are still mated with double-sided polyester adhesive, with the result that the angle of the cut in the edge of the laminate section to be inlaid precisely matches the angle of the cut in the edge of the laminate section to receive the inlay.

4 Claims, 3 Drawing Sheets

FIG. 1
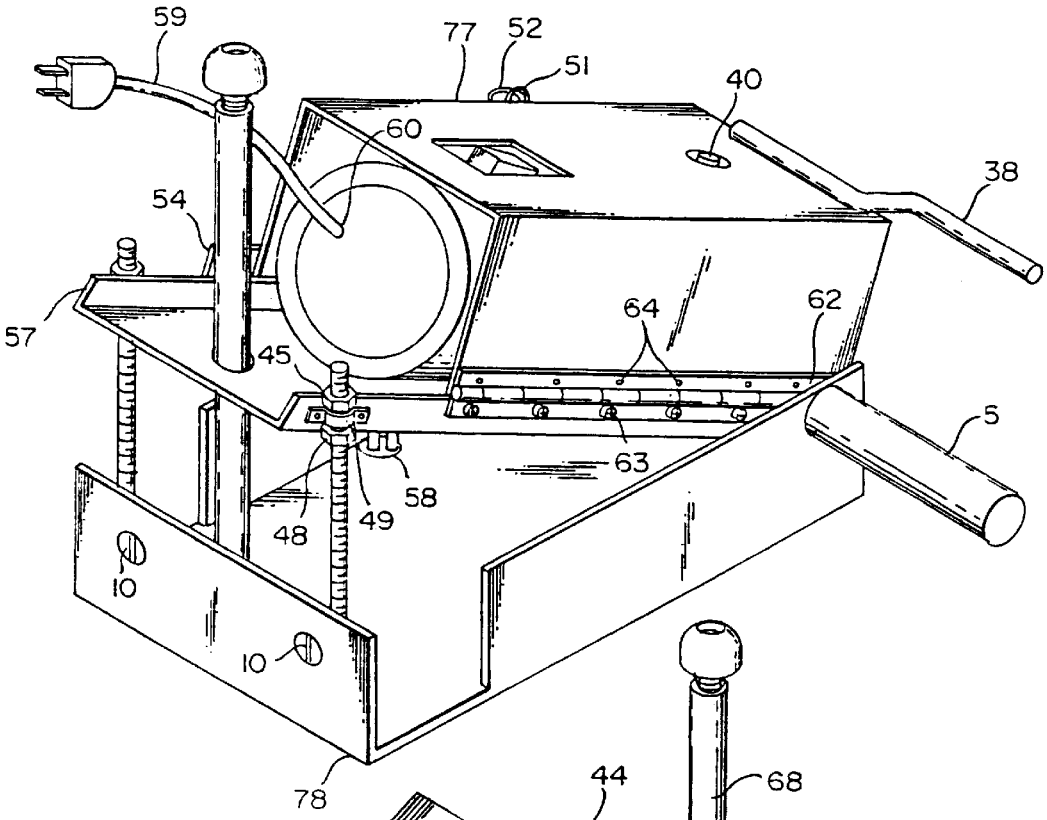
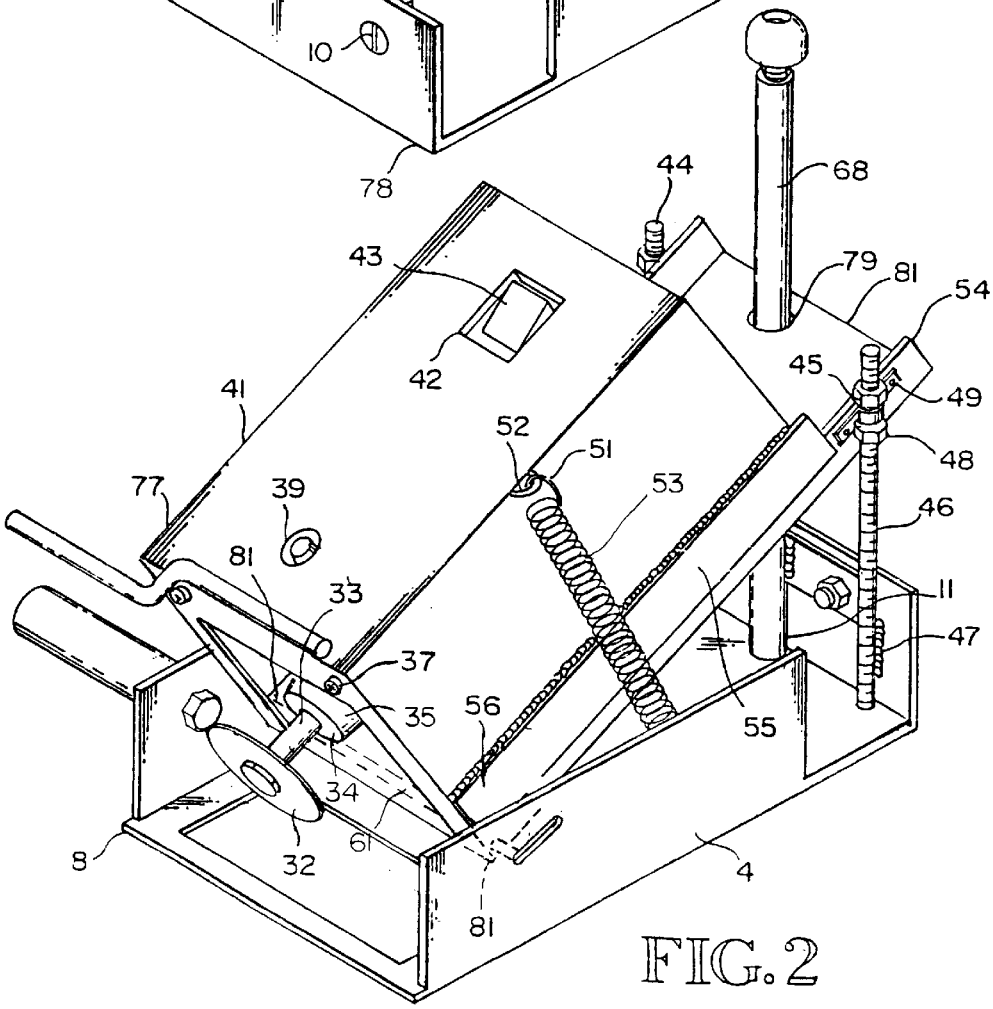
FIG. 2

FIG. 3
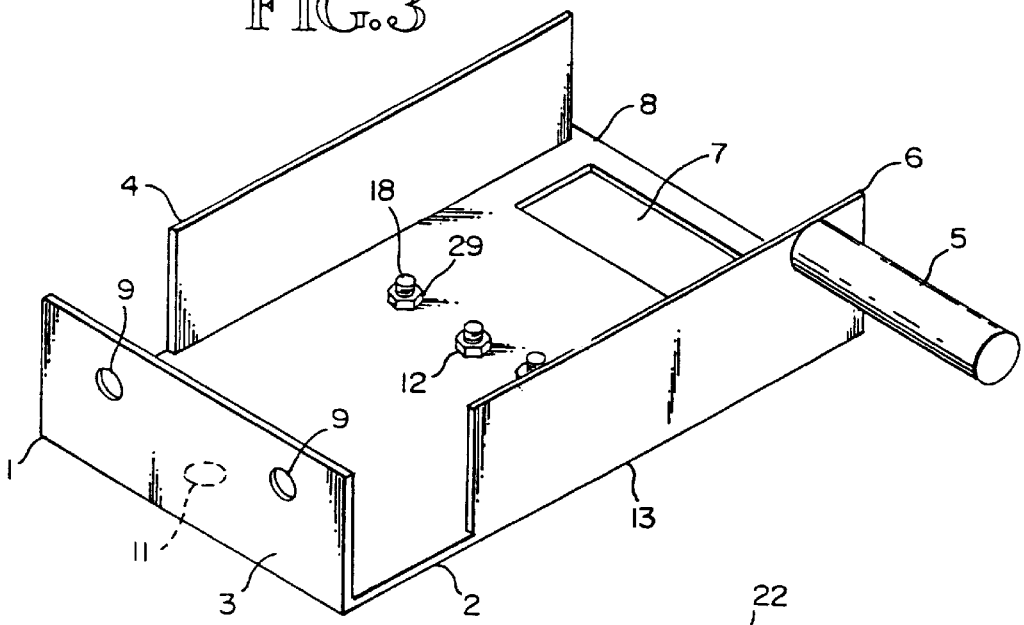
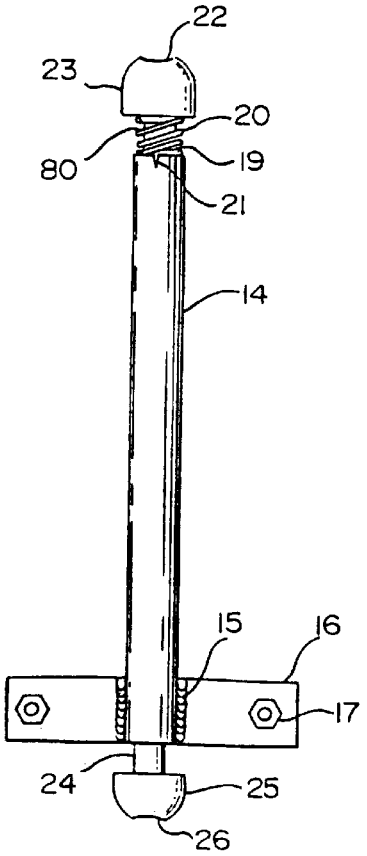
FIG. 4
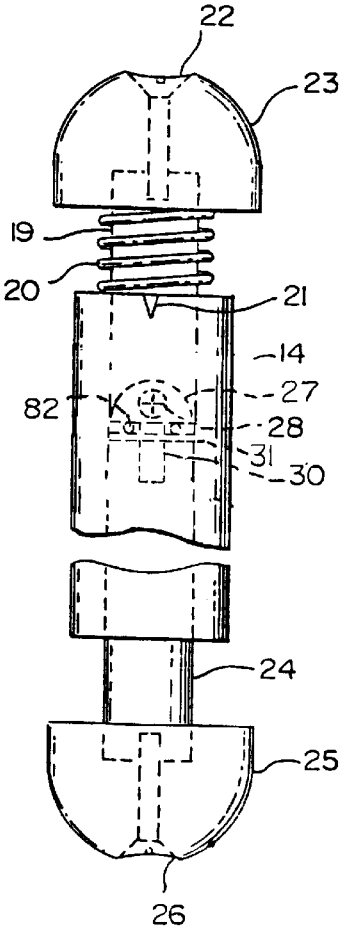
FIG. 5

LAMINATE INLAY CUTTING TOOL

BACKGROUND OF THE INVENTION

This invention relates generally to a tool and method for using a router with a cutting blade for simultaneously cutting two or more laminate sheets so that the section cut from one sheet will precisely fit into the section cut-out of the other sheet. It is known that a router fitted with a cutting bit or blade can be used to cut hard materials, such as wood, composites, and sheets of laminate. It is also known that a router with a cutting blade can be mounted to precisely score laminate, such as U.S. Pat. No. 3,841,369, and that such a router can be mounted on an adjustable mount to control the angle of the cutting plane, such as U.S. Pat. No. 4,655,653.

None of the prior art discloses a portable tool to enable the use of a router with a cutting blade to simultaneously cut designs from laminate sections to be inlaid and the section of the laminate to receive the inlay, from sheets of laminate. Prior to this invention, in order to cut a design from a sheet of laminate for inlay into another sheet of laminate, such as for a counter top, it was necessary to cut the receiving sheet and then to hand fit the inlay design into the space in the receiving sheet. This is time consuming and labor intensive, requiring highly skilled craftsmen to even get the edges of the inlay close to the edges of the space in the receiving sheet. The most difficult part of the operation is mating the cut angle on the edge of the inlay to the cut angle of the edge of the sheet receiving the inlay.

The primary object of this invention is to provide a portable, hand held means to simultaneously cut laminate sections to be inlaid and the section of the laminate to be removed to provide space to receive the inlay, from sheets of laminate. A further object is to enable the shape of the inlay to be curved or straight, so that the operator can cut various designs for inlay purposes. Another object is to enable inlays to be cut and installed in sheets of laminate by relatively unskilled workmen and even hobbyists. Still another object is to be able to change the angle of the cut face of the inlay and the cut face of the receiving sheet of laminate and still have a precise match when they are joined.

SUMMARY OF INVENTION

These objects are achieved by this invention and method of its use in that it combines a router with a cutting blade with a portable cradle, having a base with a retractable pivot for precise movement of the cutting blade in an arc, a router box comprised of two pieces, a top and a bottom joined by hinge means on one side and the other side held together by spring means with the router firmly attached to the top of the router box so that the router and its cutting blade can be lifted from the laminate sheet by rotating the top of the router box around the hinge means, thus allowing cuts in the laminate sheets to be started and stopped at any point required by the design of the inlay. Further, the router box is hingedly attached to the base of the portable cradle at the end nearest to the cutting blade and the angle of the cut by the cutting blade can be adjusted by blade angle adjustment screws, located on either side of the bottom of the router box at the end opposite to the hinge, which raise or lower that end, and the base contains a retractable pivot at the rear of the base, which when extended below the base engages the laminate sheet allowing the portable cradle to rotate around the pivot so that the cutting blade can cut exact curves in the laminate sheets. Likewise, the end of the base extending beyond the router cutting blade has a straight edge guide along its width. An alternative for setting the angle of the cutting blade is to move the blade angle adjustment hinge to the rear of the bottom of the router box and attach it to an extension of the rear of the base and install the left and right adjustment screws on the front of the base of the router box. In either case, a blade angle gauge, calibrated to translate the angle of the cutting blade to the movement of the blade angle adjustment screws.

The method of this invention includes the steps involved in utilizing the tool of this invention to simultaneously cut sections from two or more sheets of laminate, each still mated with double-sided polyester adhesive. The cutting blade is set to the desired angle and length of radius from the retractable pivot, as described above. The cutting blade is rotated up and away from the base of the portable cradle while the portable cradle is positioned upon the top sheet of laminate. The retractable pivot is depressed to engage the surface of the top sheet of laminate, if the first cut is to be a curve, or not if the first cut is to be a straight line, utilizing the straight edge. When the cut is completed, the cutting blade is again rotated up and away from the base of the portable cradle, thus disengaging the cutting blade from the laminate sheet. There may be many such cuts in any laminate design. When the cut of the inlay design is complete, the laminate sheets are separated and the section cut from the top sheet is inlaid into the place in the lower sheet from which a similar section has been cut.

The novel features of the invention and method for its use will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

BRIEF DESCRIPTION OF THE DRAWINGS

FIG. 1 is an elevational view of my invention from the right rear aspect.

FIG. 2 is an elevational view of my invention from the left front aspect.

FIG. 3 is an elevational view of the base.

FIG. 4 is an elevational view of the retractable pivot.

FIG. 5 is a sectional view of the retractable pivot.

DESCRIPTION OF THE PREFERRED EMBODIMENTS

Figure 6:
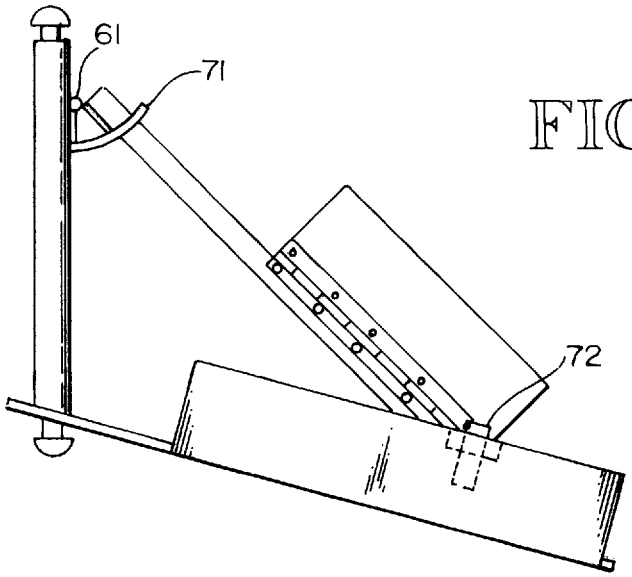
FIG. 6 is an elevational view of the blade angle fine adjustment option.

FIGS. 1 and 2, show a preferred embodiment of the invention being comprised of a router (60), such as a Porter Cable #7310, with electric power cable (59), power switch (43), chuck lock (40), a front (35) equipped with a chuck (34) to receive and hold a shaft (33), which length is adjustable by inserting or withdrawing it from the chuck (34), and a cutting blade (32) fixedly attached to the end of the shaft (33) so that when the router (60) motor turns the chuck (34) it turns the shaft (33) and the shaft turns the cutting blade (32), and a portable cradle (78) comprised of a base (1), a router box (77), a retractable pivot (68), and a blade angle adjustment means (44, 45) or (72, 74).

FIG. 3 shows the portable cradle (78) base (1) comprised of suitably rigid material, such as steel plate, and having a flat bottom (2), with hinge attachment holes (12) therethrough, being counter sunk in the under surface (13) of the bottom (2) of the base (1) so that it remains free of obstructions to the smooth travel of the portable cradle (78) over the surface of a laminate sheet (65), to accommodate the heads of hinge attachment screws (18) which secure one side of the blade adjustment hinge (61) to the base (1) with hinge attachment nuts (29), the other side of the blade adjustment hinge (61) being similarly secured to the bottom (81) of the router box (77) at the end closest to the cutting blade (32), an opening in the bottom (2) of the base (1) opening of sufficient dimension to accommodate the passage of the cutting blade (32), and a hole (11) through the rear bottom (2) of the base (1) of sufficient diameter to accommodate the retractable pivot (68) and properly aligned therewith, a rear side (3), extending up 90 degrees to the flat bottom (2) of the base (1) but not communicating with the left side (4) of the base (1) or the right side (6) of the base (1), and having two screw holes (9) therethrough to receive retractable pivot attachment screws (10), a left side (4) of the base (1) extending up 90 degrees from the bottom (2) of the base (1), not communicating with the rear side (3) of the base (1) and a straight edge guide (8) setting proud from the bottom of the left side (4) of the base (1), extending from the left side (4) of the base (1) to the right side (6) of the base (1), and spanning the opening (7) in the bottom of the base (1) beyond the location of the cutting blade (32) so that the cutting blade (32) may be lifted straight up without interference from the straight edge guide (8), and a guide handle (5) protruding perpendicularly from the front of the right side (6) of the base (1).

With reference to FIGS. 4 and 5, the retractable pivot (68), located at the center rear of the base (1), is shown attached to the retractable pivot attachment plate (16) by standard weld means (15), which plate (16) is attached to the rear side (3) of the base (1) by standard screw (10) and nut (17) means, and is comprised of a retractable pivot sleeve (14), extending from the rear side (3) of the base (1) to above and through the hole in the bottom of the router box (79), a retractable pivot shaft (80), slidably housed within and extending beyond both ends of the retractable pivot sleeve (14), comprised of bottom shaft (24), with its bottom end encased in a cushioned foot (25), of material such as rubber, and removably attached thereto by screw means (26) recessed in the cushioned foot (25) so as to preserve the surface of the laminate sheet (65) when the retractable pivot is extended through the hole (11) in the bottom (2) of the base (1) to engage the surface of the laminate sheet, and a retractable pivot top shaft (19), also having its top end encased in a cushioned cap (23), affixed by screw means (22) recessed therein so as to protect the hand of the operator when depressing the retractable pivot (68) to engage the surface of the laminate sheet (65), said retractable pivot top shaft (19) being withheld from the retractable pivot sleeve (14) by a rebound spring (20) encircling the retractable pivot top shaft (19) from the cushioned cap (23) to the top of the retractable pivot sleeve (14) at which it is retained by a notch (21) for the rebound spring (20), the retractable pivot shaft (80) top shaft (19) and bottom shaft (24) being rotatably joined by a roller bearing pin (30) extending from the (31) top plate of the bottom shaft (24) to the hinge plate (27) attached to the bottom end of the top shaft (19) by a hingeplate attachment screw (28), and said top plate (31) is rotatably separated from the hinge plate (27) by multiple roller bearings (82) around the roller bearing pin (30).

FIGS. 1 and 2 show the router box (77), being open on both ends and split lengthwise at the mid-point of each side into two sections, the (41) top of the router box (77) and the bottom (81) of the router box (77), said top (41) of the router box (77) being only slightly longer than the router (60) and having a retention plate (36) at the end nearest the cutting blade (32) to which the front of the router (60) is secured on either side of the chuck (34) by a screw compatible with the router case, such as a hex head screw (37) for the Porter Cable #7310 in the preferred embodiment of the invention, an hole (39) along its span so located so as to provide access to the chuck lock (40), a cut-out (42) of sufficient dimensions and location to allow access to the power switch (43) of the router, a lifting arm (38) with which to rotate the top (41) of the router box (77) up around the hinge (62) joining the top (41) and bottom (81) at the right side of the router box (77) along the entire length of the top (41) of the router box (77), affixed to said top (41) of the router box (77) by weld points (64) and to the bottom (81) of the router box (41) with screws and nuts (63), so that the rotation of the top (41) of the router box (77) around the hinge (62) raises and lowers the cutting blade (32), thus allowing precise positioning of the start and stop of cuts in the laminate sheets (65, 67), the top (41) of the router box (77) remaining attached to the bottom (81) of the router box (77) by a retainer spring (53) fixedly attached to the inside left side (4) of the base (1) with a retainer spring anchor pin (58) and removably attached to the top of the left side (54) of the router box (77) by a retainer spring hook (51) at the end of the retainer spring (53) which engages a retainer ring (52) attached to the top (41) of the router box (77) with retainer ring welds (50), while the line of the left side (54) of the top (41) of the router box (77), where it meets the left side (57) of the bottom (81) of the router box (77), has a router box top (41) half engagement plate (55) along the entire length of the top (41) of the router box (77) by a weld bead (56), while the bottom (81) of the router box (77) extends rearward beyond the rear of the top (41) of the router box (77) to aft of the rear side (3) of the base (1) and has a hole (79) in the bottom (81) of the router base (1) of appropriate size and alignment to accommodate therethrough the retractable pivot (68), and having a router box adjustment screw arm (49) protruding from both sides of the bottom (81) of the router box (77) at the rear and aligned parallel to the bottom (2) of the base (1) so that the blade angle adjustment screws, on the right side (44) and the left side (46), fixedly attached to the rear side (3) of the base (1) with adjustment screw attachment welds (47), accept said blade angle adjustment screws (44, 46) through the unthreaded holes in the adjustment screw arms (49), while being held in relative position along the length of the blade angle adjustment screws (44, 46) by a bottom blade angle adjustment nut (48) and a top blade angle adjustment nut (45), so that the angle at which the cutting blade (32) engages the laminate (65, 67) can be adjusted by raising and lowering the rear of the bottom (81) of the router box (77) on the blade angle adjustment screws (44, 46).

Figure 7:
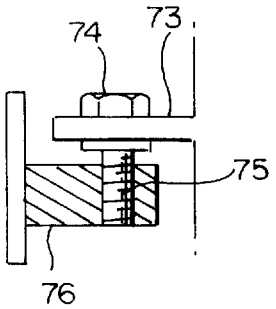
FIG. 7 is an exploded view of the blade angle fine adjustment.

FIGS. 6 and 7 show an alternative of the preferred embodiment wherein the blade angle adjustment hinge (61) is moved to the rear of the bottom (81) of the router box (77) and attached to the retractable pivot sleeve (68) and fitted with a blade angle index (71) calibrated to show the angle of the cutting blade (32) to the laminate (65, 67), and the blade angle adjustment (72) is at the front of the router box (77), comprised of a threaded blade adjustment mount (76) protruding from the inside of either side of the base (1), so located thereon to receive a blade angle adjustment screw (74) holding a router box front arm (73) in fixed position thereon by means of a stop washer (75).

Figure 8:
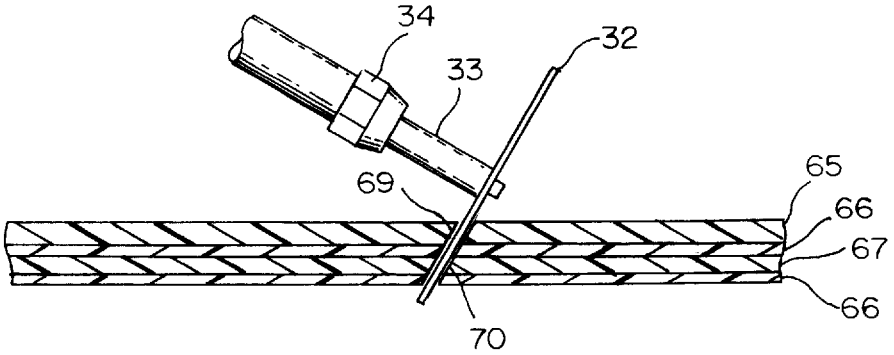
FIG. 8 is a perspective view of the method of using the router cutting blade to simultaneously cut two sheets of laminate.

FIG. 8 shows the method of using the router (60) and portable cradle (78) to simultaneously cut two sheets of laminate (65, 67), each still mated with double-sided polyester adhesive (66), so that the mating edge of the inlay laminate (69) is cut at precisely the same angle as the mating edge of the receiving laminate (70).

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A router having a case from whence an electric power cord extends from one end and chuck extends from the other, with a power switch, chuck lock, a chuck to receive and hold a shaft, which length is adjustable by inserting or withdrawing it from the chuck, and a cutting blade fixedly attached to the shaft, so that when the router motor turns the chuck it turns the shaft and the shaft turns the cutting blade, in combination with a portable cradle means to enable the router to be used to simultaneously cut two or more laminate sheets, each still mated with double-sided polyester adhesive, so that a mating edge of a section of laminate, so cut from one laminate sheet precisely matches a mating edge of the second laminate sheet, said portable cradle means comprising:

a base of rigid plate material, having a flat bottom, with an opening at one end of sufficient dimension to accommodate the passage of the cutting blade, a hole through the rear of the bottom of sufficient diameter to accommodate a retractable pivot and properly aligned therewith and regularly spaced hinge attachment holes across the bottom of the base near to the opening at one end, a rear side extending up 90 degrees to the flat bottom of the base and having screw holes therethrough to receive retractable pivot attachment screws, a left side and a right side of the base extending 90 degrees from the flat bottom of the base but not communication with the rear side of the base and a straight-edge guide setting proud from the bottom of the left side of the base and extending from the left side of the base to the right side of the base, spanning the opening in the bottom of the base beyond the location of the cutting blade so that the cutting blade may be lifted straight up without interference from the straight edge guide, and a guide handle protruding perpendicularly from the right side of the base near the end with the straight-edge guide;

a retractable pivot, located at the center rear of the base and fixedly attached to a retractable pivot attachment plate which is removably attached to the rear side of the base by screws and nuts, being comprised of a retractable pivot sleeve, extending from the rear side of the base to above and through a hole in a router box means, a retractable pivot shaft, slidably housed within and extending beyond both ends of the retractable pivot sleeve, composed of a bottom shaft, with its bottom end encased in a cushioned foot, of gripping yet non-marring material such as rubber, and removably attached thereto by a screw recessed in the cushioned foot so as to preserve the surface of the laminate sheet when the retractable pivot is extended through the hole in the bottom of the base to engage a laminate sheet, and a retractable pivot top shaft, also having its top encased in a similar cushioned cap, affixed a screw recessed therein so as to protect an operator's hand when depressing the retractable pivot to engage the laminate sheet, said retractable pivot top shaft being withheld from the retractable pivot sleeve by a rebound spring encircling the retractable pivot top shaft from the cushioned cap to the top of the retractable pivot sleeve at which it is retained by a notch therein, the retractable pivot top shaft and bottom shaft being rotatably joined by a roller bearing pin;

a router box of rigid plate material rectangular in shape, with a bottom, a left and right sides and a top, being open on both ends and split lengthwise along a midpoint of each side into two sections, the top of the router box being only slightly longer than the router, which rests therein, and having a retention plate at the end nearest the cutting blade to which the router is secured on either side of the chuck by a screw compatible with the router case, a hole along its span so located so as to provide access to the chuck lock, a cut-out of sufficient dimensions and location to allow access to the power switch of the router, a lifting arm with which to rotate the top of the router box, and thus the router and its cutting blade, up around a hinge, which joins the top and the bottom of the router box on the entire length of the split on the right side, to disengage the cutting blade from the laminate sheet, while the top of the router box remains attached to the bottom of the router box by a retainer spring and the length of the split on the left side of the router box being re-enforced with a router box top half engagement plate welded to the top of the router box, and the bottom of the router box extends rearward beyond the to of the router box to the rear side of the base and has a hole in its bottom of appropriate size and alignment to accommodate therethrough the retractable pivot; and a router box adjustment screw extending from both sides of the bottom of the base on either side of the rear side and welded thereto and extending perpendicular to the bottom of the base a sufficient distance to extend above the bottom of the router box through a router box adjustment screw arm, protruding from either side of the bottom of the router box at the rear and aligned parallel to the bottom of the base, which router box adjustment screw arm has an unthreaded hole therethrough of sufficient diameter to allow passage of the router box adjustment screw, yet being held in relative position along the length of the blade angle adjustment screws by a bottom blade angle adjustment nut and a top blade angle adjustment nut, so that the angle at which the cutting blade engages the laminate can be adjusted by raising and lowering the rear of the bottom of the router box on the blade angle adjustment screws.

2. The portable cradle of claim 1 wherein the blade angle adjustment hinge is moved to the rear of the bottom of the router box and attached to the retractable pivot sleeve and the blade angle adjustment is at the front of the router box, being comprised of a threaded blade adjustment mount protruding from the inside of either side of the base, so located thereon to receive a threaded blade angle adjustment screw holding a router box front arm fixedly positioned thereon with a stop washer.

3. The portable cradle of claim 1 wherein a blade angle index, calibrated to show the angle of the cutting blade to the laminate, is installed on either the retractable pivot sleeve or the right side of the base next to the location of the blade angle adjustment hinge.

4. A method for simultaneously cutting two or more sheets of laminate, each still mated with double-sided polyester adhesive, so that a mating edge of a section of laminate to be inlaid is precisely the same angle as a mating edge of a section of laminate to receive the section of laminate to be inlaid comprising the steps of:

providing a router with a cutting blade installed in a portable cradle having a base, a retractable pivot, a router box, and blade angle adjustment screws, as in claim 1;

setting the desired angle of the cut on the mating edges on the blade angle adjustment screws;

setting the shaft of the cutting blade in proper position to establish the desired radius for an arc to be cut by the cutting blade in the laminate;

rotating the top of the router box up and around the hinge joining the top and bottom sections of the router box thus raising the cutting blade above the bottom of the base;

setting the portable cradle at the desired location on the top surface of a stack of two or more sheets of laminate, each still mated with double-sided polyester adhesive, so that the cutting blade, when the top of the router box is lowered, will engage at the point in the laminate sheet to begin the cut for the selected design;

depressing the retractable pivot to cut an arc with the cutting blade;

allowing the retractable pivot to withdraw from the laminate to cut straight lines or free-hand with the straight edge guide and the guide handle protruding from the right side of the base;

cutting two or more stacked sheets of laminate, each still mated with double-sided polyester adhesive, results in the cutting blade cutting the mating edge of the section of the top sheet to be inlaid at the precisely same angle as the mating edge of the bottom sheet from which the section has been removed to receive the inlay.

* * * * *